US007349643B2

(12) United States Patent
Watanabe et al.

(10) Patent No.: US 7,349,643 B2
(45) Date of Patent: Mar. 25, 2008

(54) IMAGE FORMING APPARATUS AND IMAGE FORMING METHOD HAVING A CLEANER AND A PAPER DETECTING UNIT

(75) Inventors: Takeshi Watanabe, Yokohama (JP); Masashi Takahashi, Yokohama (JP); Shoko Shimmura, Yokohama (JP); Takashi Hatakeyama, Yokohama (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/709,236

(22) Filed: Feb. 22, 2007

(65) Prior Publication Data

US 2007/0147866 A1 Jun. 28, 2007

Related U.S. Application Data

(62) Division of application No. 10/938,737, filed on Sep. 13, 2004, now Pat. No. 7,206,523.

(51) Int. Cl.
*G03G 15/00* (2006.01)

(52) U.S. Cl. ..... 399/71; 399/45

(58) Field of Classification Search ..... 399/45, 399/71, 85, 51, 298, 299, 345
See application file for complete search history.

(56) References Cited

U.S. PATENT DOCUMENTS 4,727,395 A 2/1988 Oda et al.
5,822,657 A * 10/1998 Hisada et al. ..... 399/149
5,832,336 A * 11/1998 Kawasaki et al. ..... 399/71
6,029,025 A * 2/2000 Sakakibara et al. ..... 399/71
6,029,033 A * 2/2000 Kawasaki ..... 399/149
6,192,207 B1 * 2/2001 Yamamoto et al. ..... 399/82
6,968,149 B2 * 11/2005 Takahashi et al. ..... 399/347
7,030,895 B2 4/2006 Aoki et al.
2005/0100364 A1 5/2005 Nishimura

FOREIGN PATENT DOCUMENTS

JP 59-133573 A 7/1984
JP 04162055 A * 6/1992
JP 5-053414 A 3/1993

(Continued)

OTHER PUBLICATIONS

U.S. Appl. No. 10/385,716, filed Mar. 12, 2003, Aoki et al.

*Primary Examiner*—Robert Beatty
(74) *Attorney, Agent, or Firm*—Foley & Lardner LLP

(57) ABSTRACT

An image forming apparatus that forms an image using a photoconductor body includes a switching unit which effects switching between a state in which a cleaner is operated for the photoconductor body, and a state in which the cleaner is not operated for the photoconductor body. A control unit is provided which controls a setting change of an image formation condition between a case where the cleaner is operated by the switching unit, and a case where the cleaner is not operated by the switching unit. The switching unit includes a detection unit which detects the kind of paper on which an image is formed, and the switching unit switches on/off the cleaner in accordance with a detection result of the detection unit.

14 Claims, 12 Drawing Sheets

FOREIGN PATENT DOCUMENTS

| | | | | |
|---|---|---|---|---|
| JP | 09171281 | A | * | 6/1997 |
| JP | 2879883 | B2 | | 1/1999 |
| JP | 2000-298388 | A | | 10/2000 |
| JP | 2001-337503 | A | | 12/2001 |
| JP | 2002-132002 | A | | 5/2002 |
| JP | 2003-162109 | A | | 6/2003 |
| JP | 2003-162182 | A | | 6/2003 |
| JP | 2003-241511 | A | | 8/2003 |
| JP | 2003-295542 | A | | 10/2003 |

* cited by examiner

IMAGE FORMING APPARATUS AND IMAGE FORMING METHOD HAVING A CLEANER AND A PAPER DETECTING UNIT

BACKGROUND OF THE INVENTION

1. Field of the Invention

The present application is a divisional of U.S. application Ser. No. 10/938,737, filed Sep. 13, 2004 now U.S. Pat. No. 7,206,523, the entire contents of which is incorporated herein by reference.

The present invention relates to an image forming apparatus, such as a digital copying machine, for forming a color image, and an image forming method.

2. Description of the Related Art

In a conventional image forming apparatus, a cleanerless process, in which a cleaner such as a blade is not provided on a photoconductor body surface, is an advantageous technique for reduction in size of the apparatus or in reduction in amount of toner consumed. There have been various inventions relating to this technique. For instance, U.S. Pat. No. 4,727,395, Jpn. Pat. Appln. KOKAI Publication No. 59-133573 and Japanese Patent No. 2879883 disclose simultaneous development/cleaning techniques in a reverse development process.

This technique is particularly effective even in a full-color process of image forming apparatus that have been developed in recent years. The technique has recently been adopted in 4-series tandem type apparatus.

The cleanerless process has three merits:

1. Since a photoconductor body cleaner is needless, the structure is simplified.

2. Since the photoconductor body is not abraded by a cleaner, the life of the photoconductor body is elongated.

3. Since waste toner is recovered and reused, the toner consumption efficiency increases and no waste toner is produced.

However, the 4-series tandem type color image forming apparatus has the following two demerits, which weaken the advantageous effects:

1. Reverse transfer occurs from a front-stage color station to a rear-stage color station, color mixing occurs depending on the type of an image to be printed, and consequently a color hue may vary.

2. It is necessary to print a pattern, an image, etc. for maintaining image quality, even on a transfer belt or an intermediate transfer medium. As a result, waste toner is produced. Even if a cleaner for a photoconductor body is dispensed with, a waste-tonerless system cannot be realized in the entire apparatus.

The cleanerless process in an ordinary image forming apparatus has the following three demerits:

1. Since the photoconductor body is not abraded by a blade, filming of toner (fixation of toner) may occur on the photoconductor body surface if the photoconductor body surface has poor compatibility with the toner.

2. Since post-transfer residual toner passes by a charging section and an exposing section, memory may easily occur on the image due to, in particular, the effect relating to the exposing section.

3. There is a concern about color mixing in a color process, as mentioned above.

In recent years, when an attempt to enhance the image quality is made by using a toner with a relatively high sphericity, such as a polymer toner, or a toner with a small grain size, a proper margin becomes narrower with use of a blade cleaner, compared to the case of using conventional toner, and it becomes difficult to obtain an enough life of the cleaner or photoconductor body. From this standpoint, too, attention has recently been paid to the cleanerless process that does not require a blade cleaner. Furthermore, in the cleanerless process, the transfer efficiency is improved by using the above-mentioned toner. Thus, the image quality can be maintained to a certain degree even in the cleanerless process.

Even in this situation, reverse transfer frequently occurs depending on the kind of paper to be used. In particular, when thick paper is used, a sufficient performance is difficult to achieve. Jpn. Pat. Appln. KOKAI Publication No. 2003-162182, for instance, discloses an example in which a special condition is set for a thick-paper mode. In this publicly known example, a blade cleaner is not provided on the photoconductor body. Using a charger, a control is executed to discharge reverse-transfer toner into a developing device or a cleaner of a transfer belt, etc.

In this method, however, after thick paper is fed, an excess time is needed for the discharge, etc. In addition, a load on the charger itself is large, and consequently the life of the charger may be shortened or the performance of the charger may deteriorate thereafter.

There is a method wherein a dedicated cleaner for the photoconductor body is not used, and the following complex operation or control is performed. That is, toner is once recovered by a charger, etc., and the recovered toner is discharged onto the transfer belt at a non-printing time, and then the toner is recovered by belt cleaner. In this method, however, an exact control of the charge polarity of toner is difficult. This method is disadvantageous in terms of image quality, compared to the case of using a dedicated cleaner.

If no importance is placed on the life or cost, it is better to clean the photoconductor surface once image formation is completed, and thereby a higher image quality is obtained. Besides, it is difficult to achieve a high resolution if optimization for a cleanerless process is executed and an exposure condition is set for making memory less visible. However, as regards whether a high image quality is always necessary for the user at high cost, it depends greatly on the user's sense of value.

BRIEF SUMMARY OF THE INVENTION

The object of an aspect of the present invention is to provide an image forming apparatus and an image forming method, which can easily effect switching between the setting with a low-cost priority and the setting with a high-quality priority.

According to an aspect of the present invention, there is provided an image forming apparatus that forms an image using a photoconductor body including a switching unit which effects switching between a state in which a cleaner is operated for the photoconductor body, and a state in which the cleaner is not operated for the photoconductor body. A control unit is provided which controls a setting change of an image formation condition between a case where the cleaner is operated by the switching unit, and a case where the cleaner is not operated by the switching unit. The switching unit includes a detection unit which detects the kind of paper on which an image is formed, and the switching unit switches on/off the cleaner in accordance with a detection result of the detection unit.

According to another aspect of the present invention, there is provided an image forming method for an image forming apparatus that forms an image using a plurality of photoconductor bodies, the method comprising: providing a cleanerless cartridge that is attached to the image forming apparatus and includes a mechanism that recovers post-transfer residual toner which occurs in an image forming step using the photoconductor body, into a developing device; providing a cleaner-equipped cartridge that is attached to the image forming apparatus and includes a mechanism that employs a cleaner to recover post-transfer residual toner which occurs in an image forming step using the photoconductor body; detecting whether the cleanerless cartridge is attached to the image forming apparatus or the cleaner-equipped cartridge is attached to the image forming apparatus; and controlling a setting change of an image formation condition on the basis of a detection signal of said detecting.

Additional objects and advantages of an aspect of the invention will be set forth in the description which follows, and in part will be obvious from the description, or may be learned by practice of the invention. The objects and advantages of an aspect of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the embodiments given below, serve to explain the principles of an aspect of the invention.

DETAILED DESCRIPTION OF THE INVENTION

Embodiments of the present invention will now be described with reference to the accompanying drawings.

Figure 1:
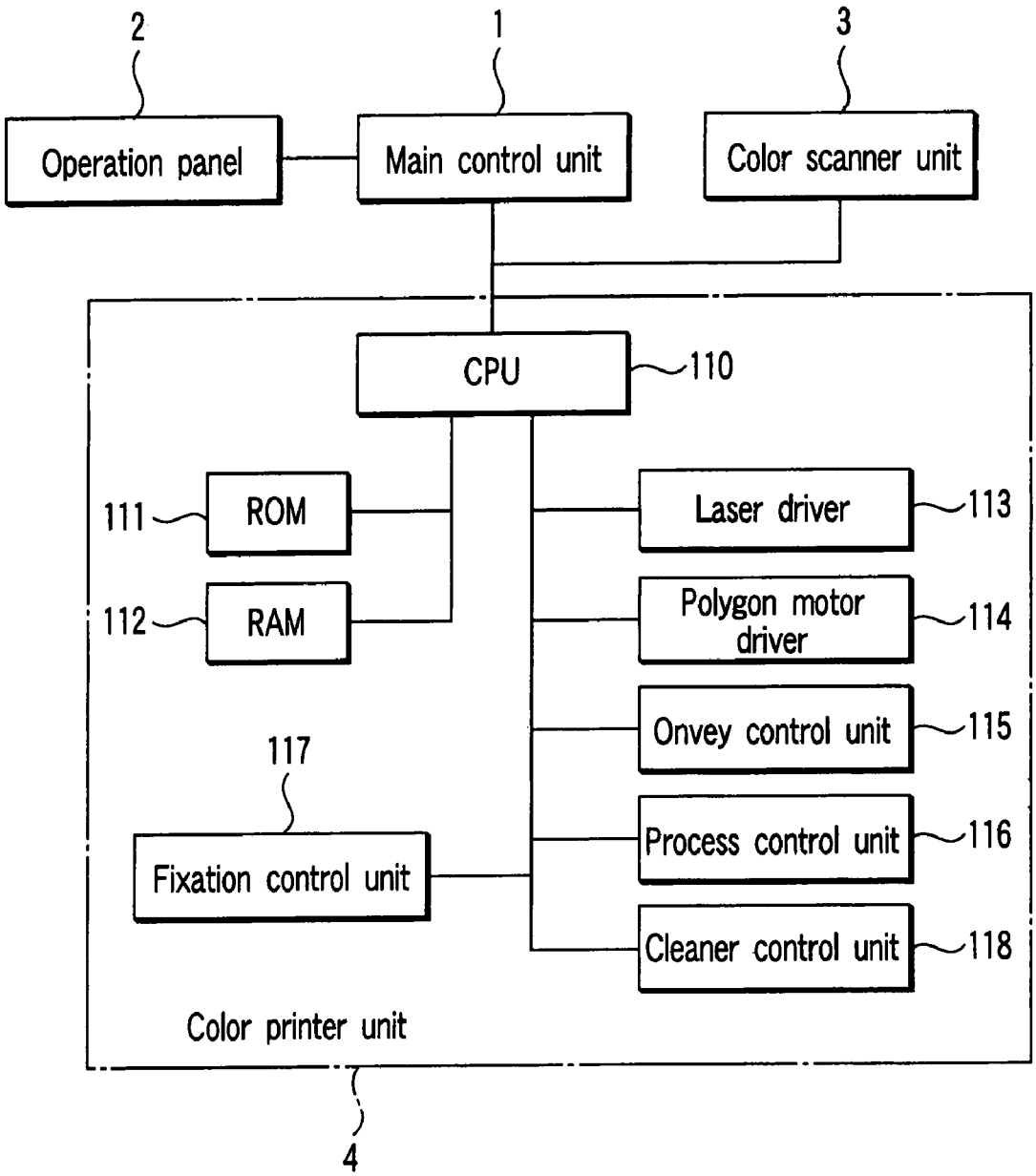
FIG. 1 is a block diagram showing the structure of a control system of an image forming apparatus according to the present invention.

FIG. 1 shows the structure of a control system of an image forming apparatus according to the present invention. The image forming apparatus comprises a main control unit 1 that executes an overall control of the apparatus, an operation panel 2 that operates various settings, a color scanner unit 3 that serves as image reading means for reading a color image on an original, and a color printer unit 4 that serves as image forming means for forming an image.

The color printer unit 4 comprises a CPU 110 that executes an overall control of the unit, a ROM 111 that stores a control program, etc., a RAM 112 for data storage, a laser driver 113 that drives a semiconductor laser (not shown), a polygon motor driver 114 that drives a polygon motor (not shown), a convey control unit 115 that controls conveyance of paper, a process control unit 116 that controls a process for charging, development and transfer, using a charger (not shown), a developing roller and a transfer device, a fixation control unit 117 that controls a fixing device (not shown), and a cleaner control unit 118 that controls a cleaner-equipped process and a cleanerless process, as will be described later in detail.

Next, a first embodiment of the invention is described.

Figure 2:
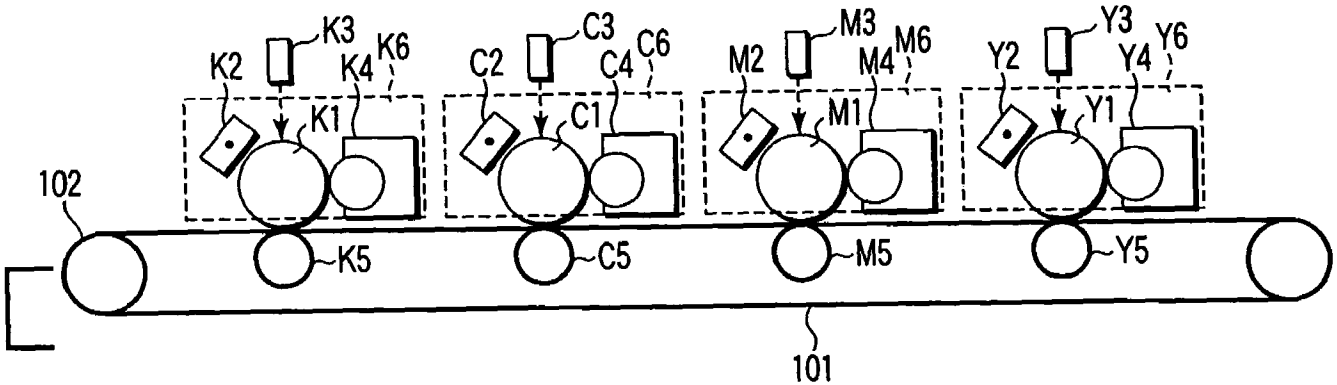
FIG. 2 schematically shows the constitution of a cleanerless process.

FIG. 2 schematically shows the constitution of a cleanerless process in this image forming apparatus. This apparatus is a so-called tandem-type image forming apparatus. A plurality of image forming sections (stations) Y6, M6, C6 and K6 are arranged on a transfer belt 101 that serves as paper conveying means.

The first-stage image forming section Y6 forms a yellow image, the second-stage image forming section M6 forms a magenta image, the third-stage image forming section C6 forms a cyan image, and the fourth-stage image forming section K6 forms a black image.

In the first-stage image forming section Y6, a photoconductor body Y1 serving as an image carrier is a photoconductor drum that is configured such that an organic or amorphous silicon photoconductor layer is provided on an electrically conductive body.

In this embodiment, an organic photoconductor body that is charged with negative polarity is employed by way of example.

The photoconductor body Y1 is uniformly charged at, e.g. −500V by a well-known charger Y2. Then, the photoconductor body Y1 receives an image-modulated laser beam or exposure light Y3 from an LED, etc. An electrostatic latent image is formed on the surface of the photoconductor body Y1. At this time, the exposed surface of the photoconductor body Y1 has a potential of, e.g. about −80V. Thereafter, the electrostatic latent image on the photoconductor body Y1 is developed into a visible image by a developing device Y4. The developing device Y4 adopts a two-component development scheme, wherein a nonmagnetic toner that is negatively charged is mixed with magnetic carrier. In the developing device Y4, a magnetic brush is formed of the carrier on a developing roller that includes a magnet. A voltage of about −200 to −400V is applied to the developing roller. Thereby, toner adheres to the exposed part of the surface of the photoconductor body Y1, while no toner adheres to the non-exposed part.

The visible image on the photoconductor body Y1 is transferred to paper, which serves as a transfer medium, by means of the transfer belt 101 that is put in contact with the photoconductor body Y1. In this case, application of an electric field is effected by a transfer roller Y5 serving as a transfer member, which is put in contact with the back surface of the transfer belt. The voltage that is applied to the transfer member is about +300V to 3 kV.

Where necessary, residual toner, etc., which is left on the photoconductor body Y1 after transfer, is subjected to a stirring member (not shown) for removing memory of a post-transfer residual image. Further, the photoconductor body Y1 is subjected to a charge erase process, as desired, and the above-described charging step is repeated.

In this case, the post-transfer residual toner, which has passed by the charging section of the charger Y2, has been subjected to the charging step and thus the toner is charged with the same polarity as the charge potential of the photoconductor body (the negative polarity in this embodiment). When the post-transfer residual toner reaches the developing section of the developing device Y4, development is effected with the post-transfer residual toner remaining on an image are on the photoconductor body Y1, and the post-transfer residual toner on a non-image area is recovered to the developing roller side. A so-called simultaneous developing/cleaning operation is executed. Thereby, even where a cleaning device such as a blade is not provided on the photoconductor body Y1, the electrophotographic process of the first-stage image forming section Y6 is successively carried out.

Next, the second-stage image forming section (station) M6 is described.

The second-stage image forming section M6 comprises a photoconductor body M1, a charger M2, exposure light M3, a developing device M4 and a transfer roller M5. The basic structure is the same as that of the first-stage image forming section Y6.

In the transfer section of the transfer roller M5, however, an image comes in, which has been formed by the preceding image forming section Y6 and transferred on the transfer medium, such as paper, on the transfer belt 101. Depending on conditions, such a phenomenon occurs that a part of the image formed by the first-stage image forming section Y6 is reverse-transferred on the photoconductor body M1. In this case, the toner that is transferred on the transfer belt 101 or paper has negative polarity, whereas a voltage of about +300V to 3 kV is applied to the transfer roller M5. Thus, it is basically assumed that the toner transferred in the first-stage section does not shift from the transfer belt 101 or paper.

However, if an excessive discharge phenomenon occurs at the transfer section of the transfer roller M5, part of the toner is reversely charged with positive polarity and adheres to the photoconductor body M1. The toner from the first-stage section, which adheres to the photoconductor body M1, is subjected to the same process as in the first-stage section. Consequently, the toner is restored to the negative polarity at the charging section of the charger M2 and mixes into the developing device M4. Depending on conditions, a color mixing phenomenon would occur.

Subsequently, the third-stage image forming section C6 and fourth-stage image forming section K6, which are configured similarly with the second-stage section, are arranged.

The transfer section, which is employed in this embodiment by way of example, is a direct-transfer type wherein the transfer belt serves as paper conveying means. Alternatively, the transfer section may adopt other transfer schemes such as an intermediate transfer scheme. In the intermediate transfer scheme, the transfer belt does not feed paper, and an image on the photoconductor body is directly transferred to a belt, a roller, etc. by means of the first- to fourth-stage image forming sections, following which the image is transferred at a time from the belt or roller to a transfer medium such as paper.

Figure 3:
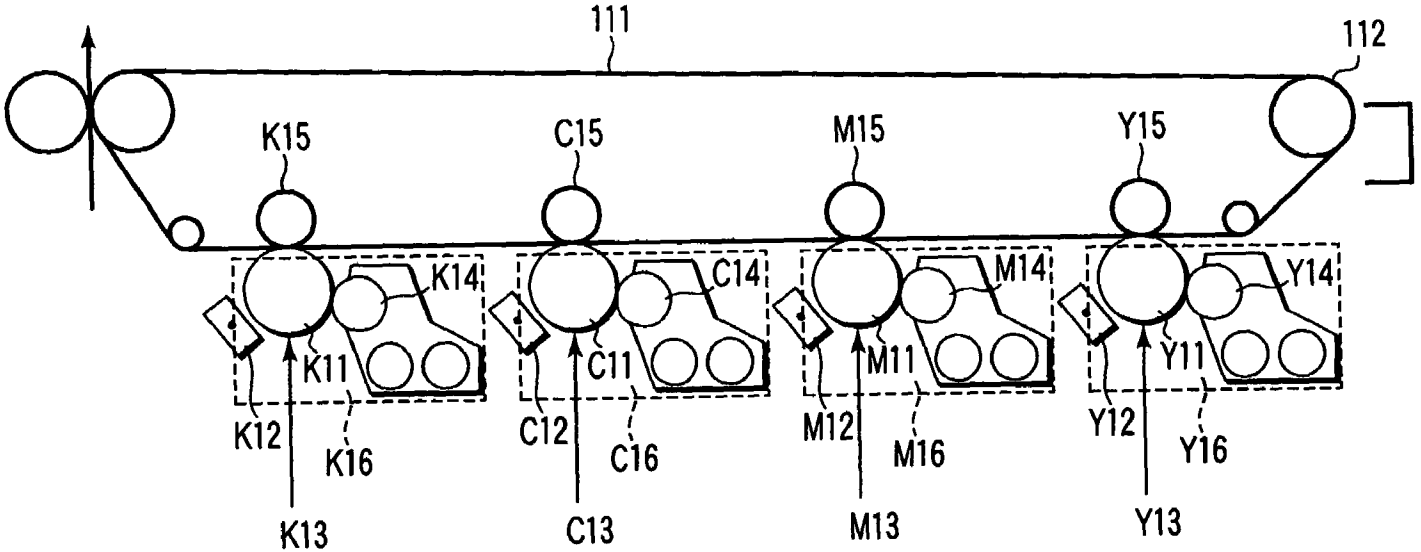
FIG. 3 shows an example in which an intermediate transfer belt is used.

FIG. 3 shows an example in which an intermediate transfer belt 111 is used. A detailed description thereof is omitted.

Figure 4:
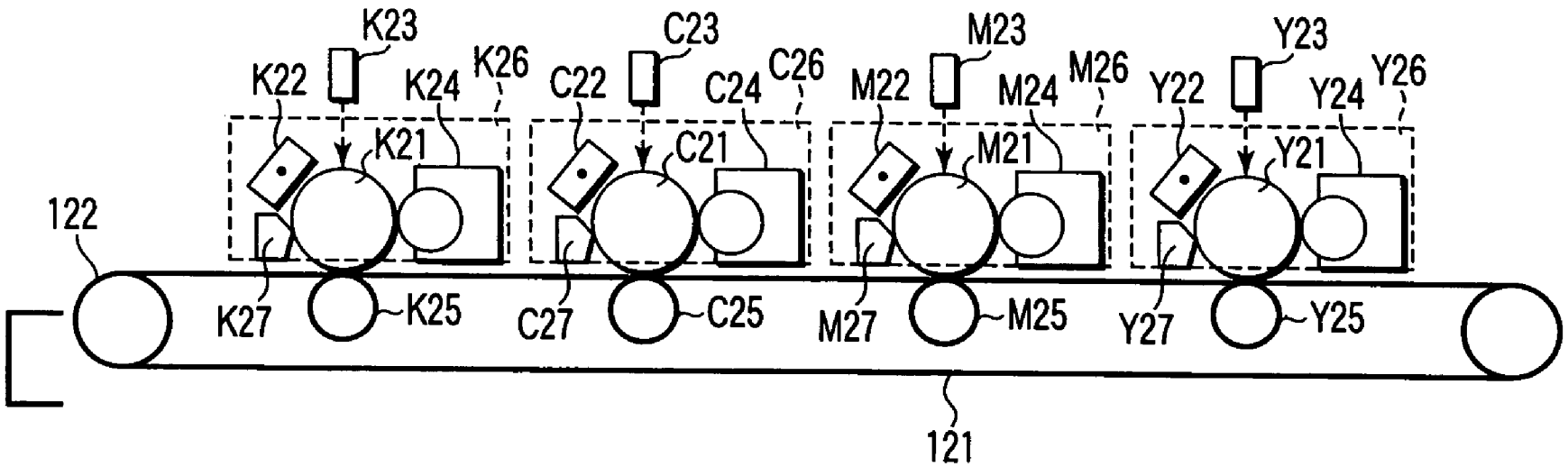
FIG. 4 shows an ordinary cleaner-equipped configuration.

FIG. 4 shows an ordinary cleaner-equipped configuration.

In this example, cleaners Y27, M27, C27 and K27 such as blades are provided as cleaning means at a position following the transfer step and preceding the charging step in FIG. 2. This is an ordinary electrophotographic process. In the second and following image forming sections, reverse-transfer toner is recovered by the cleaners. Therefore, there arises no problem of exposure memory, color mixing, etc.

In this embodiment, in each image forming section, the photoconductor body, charger and cleaner are formed as an integral cartridge that is removable from the image forming apparatus body. In this case, a cleaner-equipped cartridge and a cleanerless cartridge are prepared. Both cartridges are equally detachable/attachable from/to the image forming apparatus. The image forming apparatus has detection means for detecting which of the cleaner-equipped cartridge and the cleanerless cartridge is attached.

Figure 6:
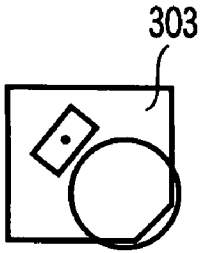
FIG. 6 shows the structure of a cartridge.
Figure 5:
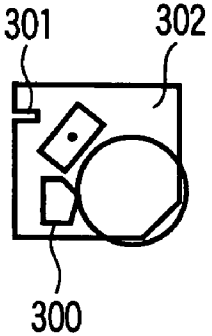
FIG. 5 shows the structure of a cartridge.
Figure 7:
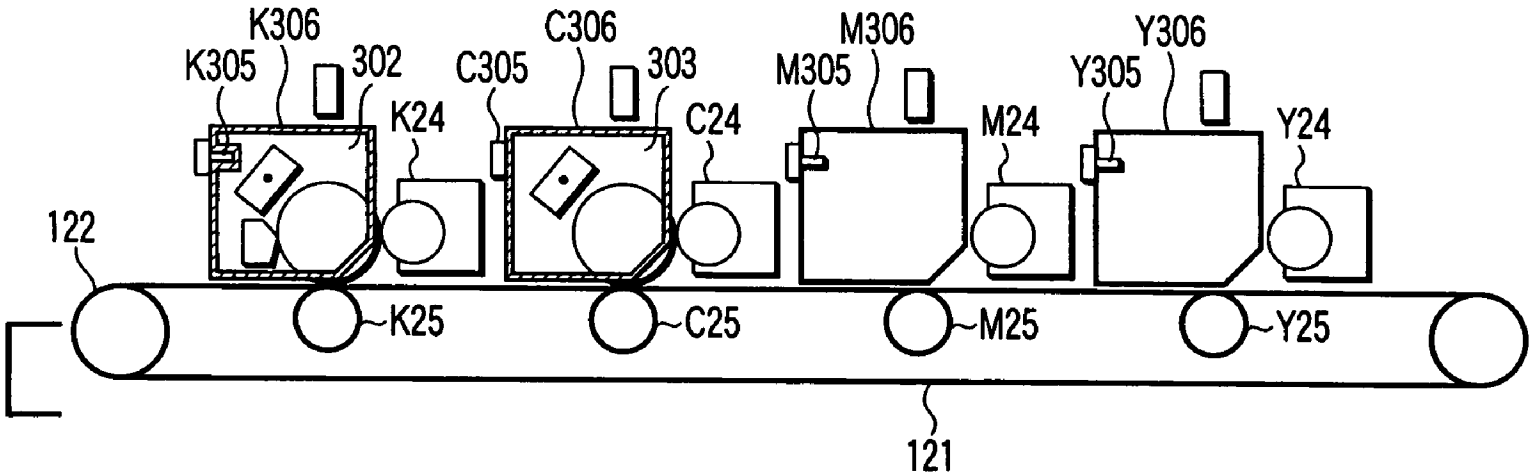
FIG. 7 shows an example of an image forming apparatus to which a cartridge can be attached.

FIGS. 5 to 7 show examples of the cartridges and the image forming apparatus to which the cartridges can be attached.

FIG. 5 shows a cleaner-equipped cartridge 302 that includes a cleaner 300. A recess 301 is formed in advance in a part of the cartridge 302. FIG. 6 shows a cartridge 303 for a cleanerless process. The cartridge 303 has no recess.

As is shown in FIG. 7, insertion openings Y306, M306, C306 and K306 for insertion of the cartridge are provided on the apparatus body side. Each insertion opening is provided with a switch (Y305, M305, C305, K305) for determining whether the attached cartridge is the cleaner-equipped cartridge 302 or the cleanerless cartridge 303. The switches Y305, M305, C305 and K305 are connected to the cleaner control unit 118.

For example, when the cleaner-equipped cartridge 302 is inserted in the insertion opening K306, the switch K305 is not pressed and is set in the off-state. Thus, the apparatus body determines the attachment of the cleaner-equipped cartridge 302.

For example, when the cleanerless cartridge 303 is inserted in the insertion opening C306, the switch C305 is pressed and set in the on-state since the cleanerless cartridge 303 has no recess. Thus, the apparatus body determines the attachment of the cleanerless cartridge 303.

Figure 9:
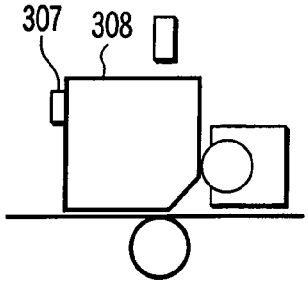
FIG. 9 shows an example in which a receiving unit is attached to an image forming apparatus body.
Figure 8:
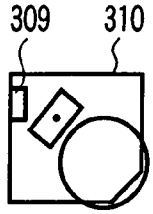
FIG. 8 shows an example in which a wireless tag is built in a cartridge.

As is shown in FIG. 8, a wireless tag 309 may be built in the cartridge 310. A unique signal from the tag 309 is received by a receiving unit 307 provided on the image forming apparatus body, as shown in FIG. 9. Specifically, a unique signal is transmitted from the wireless tag 309 of the cartridge 310 to the receiving unit 307 of the image forming apparatus body. Based on the received signal, the image forming apparatus body determines the cartridge.

Besides, an electronic circuit or the like, which stores ID information, may be provided in the cartridge in advance, and the ID information may electrically be read via a contact provided on the image forming apparatus side.

In the above-described structure, for example, when the cleaner-equipped cartridge 302 is replaced with the cleanerless cartridge 303 in the image forming apparatus body, the CPU 110 determines the replacement of the cartridge by the switch (Y305, M305, C305, K305).

In this case, the CPU 110 lowers the transfer bias to 90% of the value in the prior art, in accordance with the substituted cleanerless cartridge 303.

Figure 10:
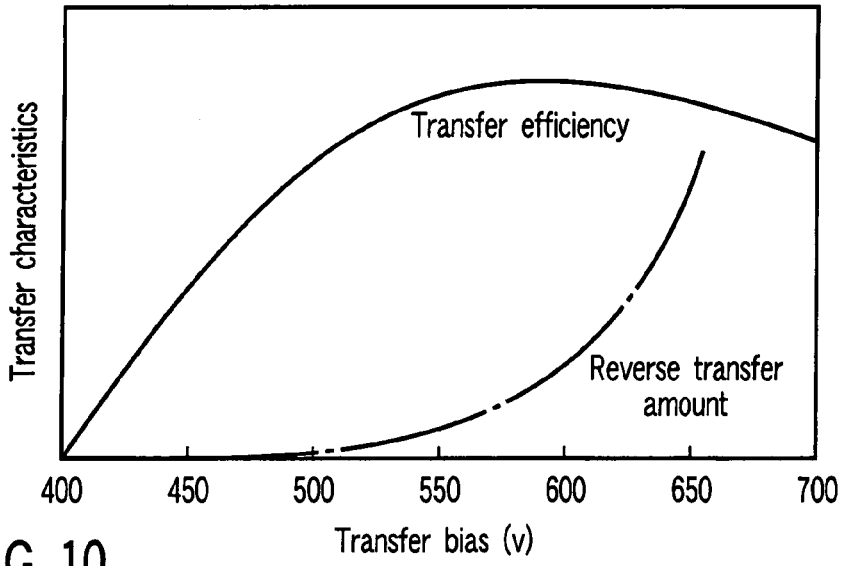
FIG. 10 is a graph showing a relationship between transfer efficiency and a reverse transfer amount.

The reason is that if the transfer bias is relatively high, the transfer efficiency is high but the reverse-transfer amount increases, as shown in FIG. 10. In other words, in the case of the cleanerless cartridge 303, the transfer bias is decreased in order to avoid the problem of color mixing, even if the transfer efficiency is somewhat sacrificed.

Normally, in the cleaner-equipped process using cleaners, if a transfer bias of 600V is used, the transfer efficiency is almost at a highest relative level but the reverse transfer amount is a little high, as indicated by a dot-and-dash line in FIG. 10. If the transfer bias is deceased to 540V, the reverse transfer amount remarkably decreases although the transfer efficiency slightly lowers. Thus, switching to the process, which is with less possibility of color mixing, can be effected.

In the cleanerless process, when exposure corresponding to an image signal is effected after the photoconductor body is charged, a slight amount of post-transfer residual toner, etc. due to the preceding process remains on the photoconductor body. This toner may become an obstacle to exposure, and image memory tends to occur. In order to cope with this problem, if the light intensity for exposure on the photoconductor body is increased, the problem can substantially be solved even if a slight amount of residual toner is present.

Figure 11:
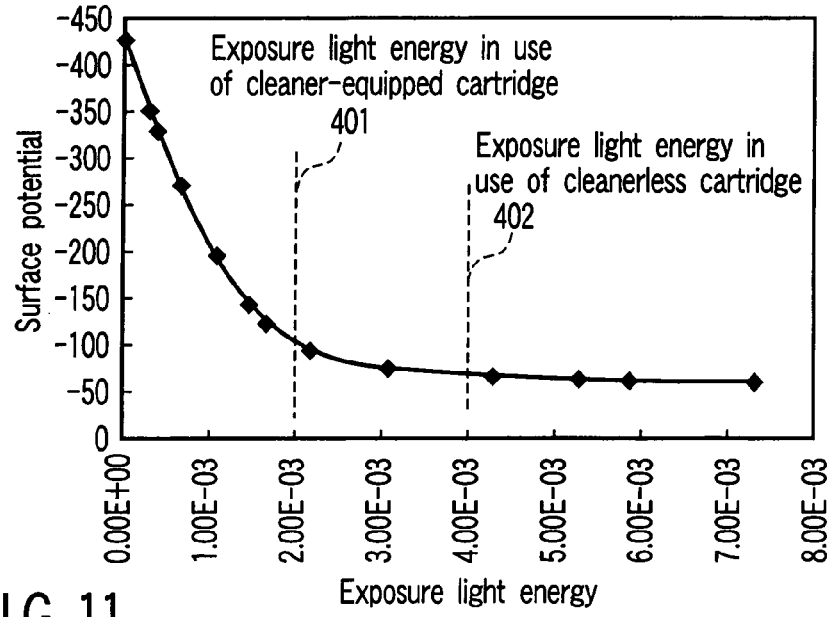
FIG. 11 is a graph showing light attenuation characteristics of a photoconductor body.

FIG. 11 shows light attenuation characteristics of the photoconductor body. In short, the post-exposure potential of the photoconductor body is saturated after exposure with light having an intensity of a certain level or more. Thus, the substantial effect of the obstacle can be reduced by irradiation of high-intensity light.

However, if the intensity of light is set at a high level, an image density sharply increases with a small pulse width, for example, when a halftone (intermediate gray scale) image is to be printed by varying the pulse width of an image signal. Consequently, it becomes difficult to represent a so-called "tone". The reason for this is that if the light intensity is set at a high level, a region where the surface potential attenuates becomes broader than intended, and so-called deformation of dots occurs. In addition, the light attenuation characteristics of the photoconductor body are such that saturation gradually progresses as the light intensity increases. Thus, if a saturated region is set as a reference, an image deforms, relative to the beam size.

Figure 12:
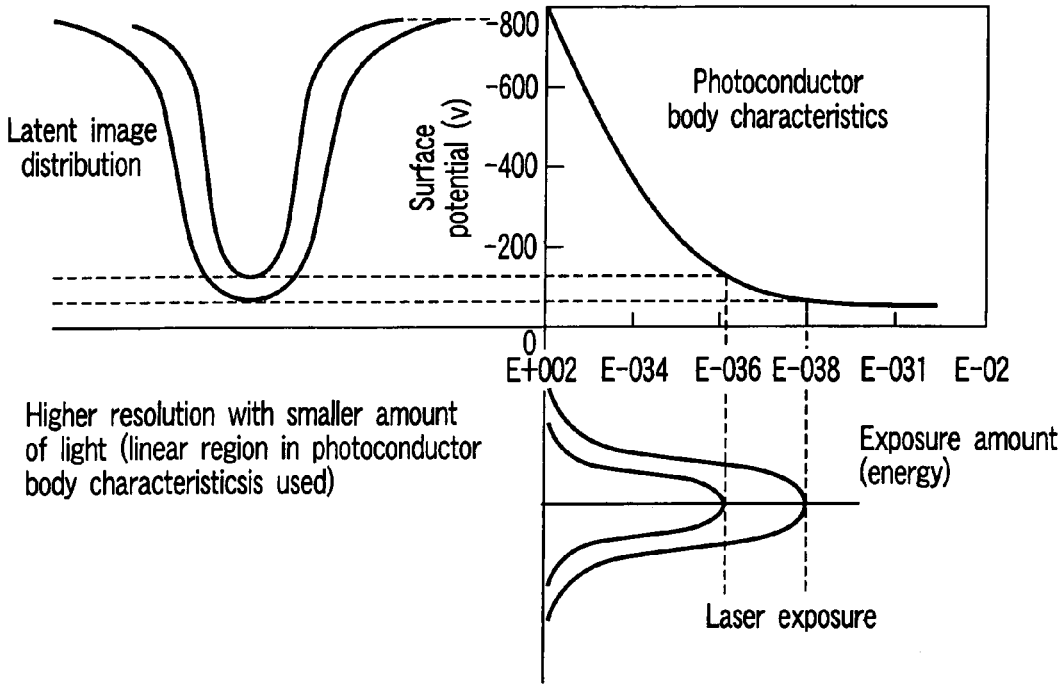
FIG. 12 is a diagram showing photoconductor body characteristics and an exposure amount.

FIG. 12 is a diagram illustrating this state. If a region of photoconductor characteristics, where a post-exposure potential is completely saturated, is set as a solid-image potential, a latent image on the photoconductor body tends to deform, and the latent image becomes thicker than the beam size at the time of actual exposure. On the other hand, if the amount of light is decreased and a region, where photoconductor characteristics are substantially linear, is set as a solid-image potential, a latent image can be formed on the photoconductor body substantially in accordance with the beam size, and a high resolution can be obtained. However, as mentioned above, since the effect of the obstacle to exposure increases, this method is not suited to the combination with the cleanerless process.

In the present embodiment, when the cleaner-equipped cartridge 302 is used, the light intensity for exposure is set at a level indicated by numeral 401 in FIG. 11. When the cleanerless cartridge 303 is amounted, the light intensity is changed to a level 402 in FIG. 11 and the image formation is performed.

Although the resolution slightly decreases when the cleanerless cartridge 303 is used, an image with no problem, which is free from exposure memory, can be obtained.

The same advantageous effect is expectable by changing the following parameters, as well as the exposure intensity.

For example, as regards the exposure light modulation scheme using a laser, etc., a description is given of the switching between a pulse width modulation scheme and a power modulation scheme.

In the pulse width modulation scheme, if a 1 dot signal can be divided into, e.g. 256, the light emission time of exposure light of, e.g. a laser is controlled. This scheme is represented by pulse width modulation 501 in the diagram of FIG. 13. In the case of a 128/256 halftone image and a 256/256 solid image, the light amount is equal but the light emission time in 1 dot is different.

Figure 13:
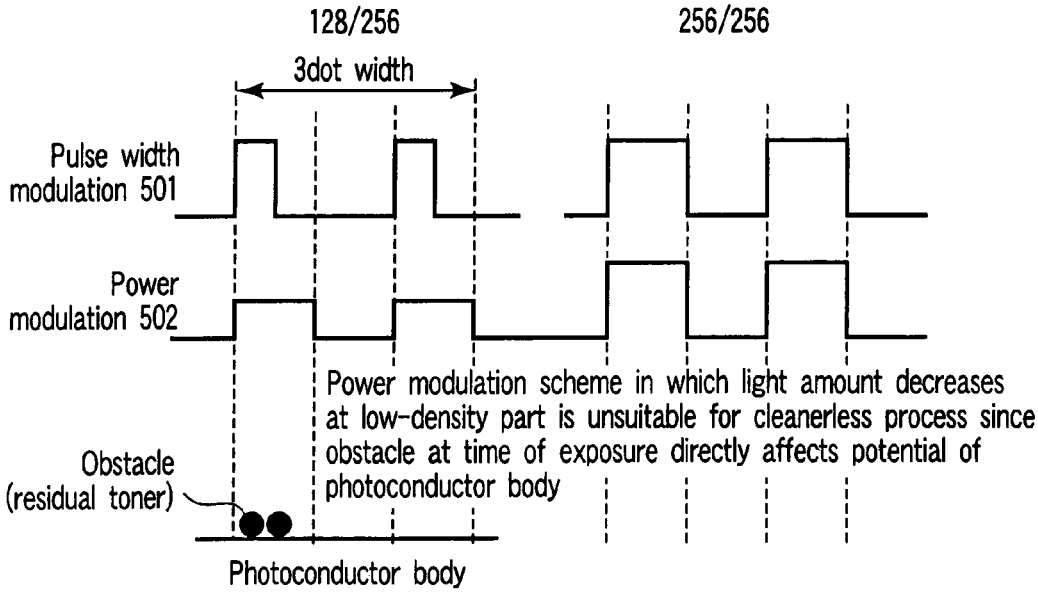
FIG. 13 is a diagram showing pulse width modulation and power modulation.

On the other hand, in the power modulation scheme, the exposure light intensity of, e.g. a laser is controlled in accordance with an image signal, as indicated by power modulation 502 in FIG. 13. In the case of a 128/256 halftone image, the light emission time j is equal to the case of 256/256 but the light amount itself is reduced to about ½. The power modulation scheme can achieve a high resolution since it is a density modulation in principle. For example, if an obstacle to exposure due to, e.g. residual transfer toner occurs in the state in which a halftone image is reproduced with this scheme, the potential of the photoconductor body varies greatly due to the obstacle. The reason is that since the photoconductor body is not in the attenuation state in which the photoconductor potential is saturated, as described above, the photoconductor body is susceptible to external factors. In short, this method is not suited to the cleanerless process.

This being the case, the power modulation scheme is adopted in the cleaner-equipped configuration with a priority placed on the resolution, and the pulse width modulation that is relatively stable against noise is adopted in the cleanerless process.

In particular, as regards exposure, even where only the third-stage image forming section, for instance, is changed to use the cleanerless cartridge, it is desirable that the settings for exposure be changed for the cleanerless process in all the first- to fourth-stage image forming sections.

In the case of the transfer control, only the transfer efficiency slightly varies. Thus, the effect on a final image, in which colors are overprinted, is small. However, in the case where the conditions for exposure are varied, if a different scheme is adopted for a particular color, matching of hue becomes difficult. In addition, it is necessary to prepare conditions for image processing by assuming respective cases. This leads to an increase in cost of the entire image forming apparatus.

Therefore, when parameters relating closely to the image processing, such as conditions for exposure, are changed, it is desirable to change the cartridges for all the image forming sections at a time, if possible. Even where this is not possible, if at least one cartridge is changed to a cleanerless cartridge, the settings for the other image forming sections are changed for the cleanerless process.

Various combinations of components in the cartridge are possible. For example, a photoconductor body and a cleaner may be combined, or a developing device, etc. may be additionally combined with these components. For example, only a cleaner section may be configured to be detachable.

These combinations are not related to the subject matter of the present invention. It is important whether the cartridge is a cleaner-equipped one or a cleanerless one.

Next, a second embodiment of the invention is described.

In the second embodiment, a cleaner-equipped cartridge and a cleanerless cartridge are not replaced with each other. An operation for switching on/off cleaning means is performed in the same apparatus, and switching is effected between a cleaner-equipped state and a cleanerless state. The mechanism for this structure is controlled by the CPU 110 via the cleaner control unit 118.

In accordance with the switching operation, the settings for exposure, transfer, etc. at the time of image formation are changed, as has been described in connection with the first embodiment. Thereby, without a time-consuming work of replacing the cartridge, the user can select, for example, a mode in which an image is printed with a toner-saving, long-life setting, or a mode in which an image is printed out with a high image quality although a relatively high cost is incurred.

Figure 14:
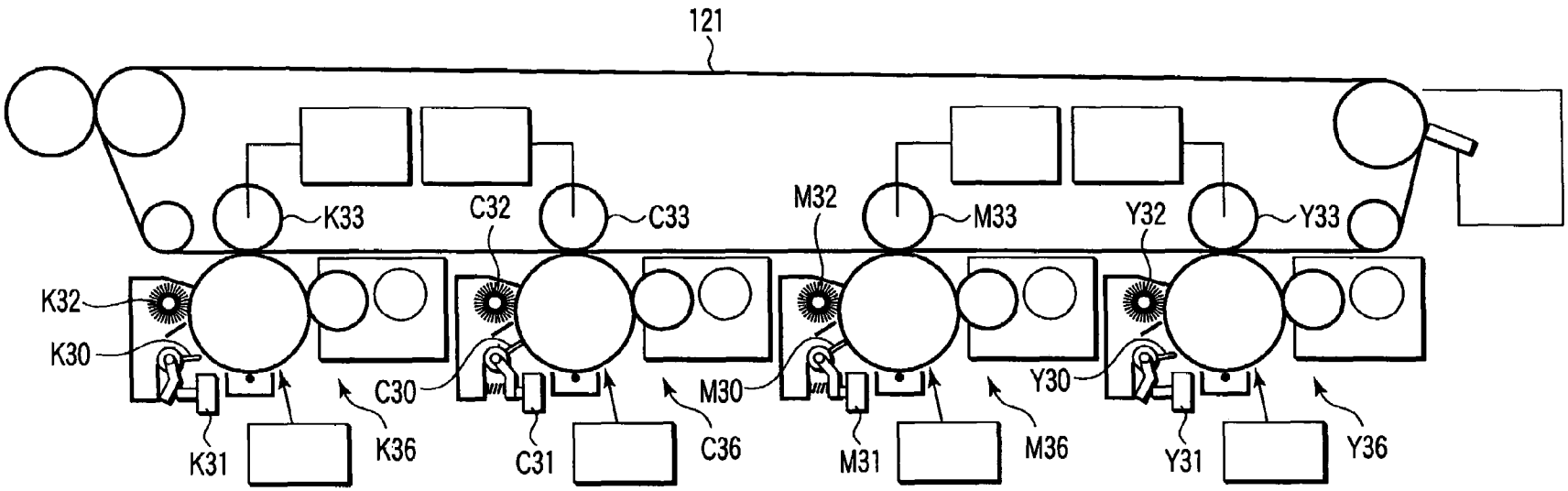
FIG. 14 schematically shows the structure of an image forming apparatus according to a second embodiment.

FIG. 14 schematically shows the structure of an image forming apparatus according to the second embodiment. In the tandem-type image forming apparatus according to the second embodiment, a plurality of image forming sections (stations) Y36, M36, C36 and K36 are arranged under a transfer belt 121 that serves as paper conveying means.

The first-stage image forming section Y36 forms a yellow image, the second-stage image forming section M36 forms a magenta image, the third-stage image forming section C36 forms a cyan image, and the fourth-stage image forming section K36 forms a black image.

As is described later in greater detail, the image forming section Y36 includes a blade Y30, a solenoid Y31, a brush Y32 and a transfer roller Y33. The image forming section M36 includes a blade M30, a solenoid M31, a brush M32 and a transfer roller M33. The image forming section C36 includes a blade C30, a solenoid C31, a brush C32 and a transfer roller C33. The image forming section K36 includes a blade K30, a solenoid K31, a brush K32 and a transfer roller K33.

Figure 15:
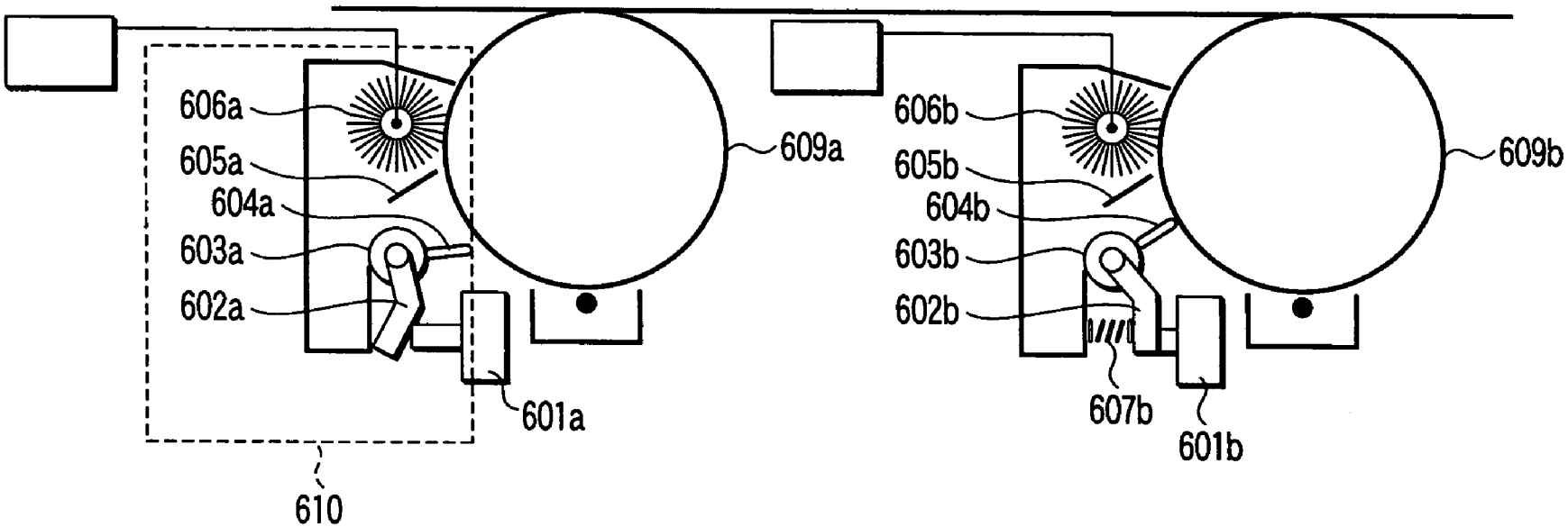
FIG. 15 shows a cleanerless state and a cleaner-equipped state in image forming sections.

FIG. 15 shows, on its left part, a cleanerless state of the image forming section, and shows, on its right part, a cleaner-equipped state of the image forming section.

A cleaner for a photoconductor body 609*b* is formed of a blade 604*b*. The blade 604*b* is always urged under a fixed pressure onto the photoconductor body 609*b* by the force of a spring 607*b*. When this state is switched to a cleanerless state by the user or a signal from the image forming apparatus body, a solenoid 601*b* operates against the force of the spring 607*b* and pushes a member 602*b* that couples the solenoid section and the blade section. The blade 604*b* is configured to be rotatable about a shaft 603*b*. When the member 602*b* is pushed, the blade 604*b* is turned and shifted away from the photoconductor body 609*b*.

In FIG. 15, the state in which the blade is separated from the photoconductor body is illustrated by elements 601*a* to 609*a*. The solenoid 601*a* operates and pushes the coupling member 602*a*, thereby compressing the spring. As a result, the cleaning blade 604*a* is shifted away from the photoconductor body 609*a*.

In the second embodiment, in a cleaner section 610 the brush roller 606*a* is put in contact with the photoconductor body 609*a*. A voltage of, e.g. about 300V is applied to the brush roller 606*a*. The resistance of the brush of the brush roller 606*a* is 10e5 to 10e9Ω, and the brush is semiconductive. The brush has a thickness of 1-6 denier. The brush roller 606*a* once recovers post-transfer residual toner with negative polarity on the photoconductor body 609*a*. However, the brush roller 606*a* does not retain the recovered toner. The brush roller 606*a* releases the toner little by little by electrifying the toner with positive polarity. The photoconductor body 609*b* is similarly provided with a brush roller 606*b*.

In the cleaner-equipped state in which the cleaning blade 604*a* is put in contact with the photoconductor body 609*b*, the toner that is released from, or passed through, the brush roller 606*b*, is all recovered by the blade 604*b*. Since the toner is once held and stirred by the brush roller 606*b*, cleaning can stably be performed by the blade 604*b* even in case a great amount of toner adheres due to paper jam or the like.

When the cleaning blade is separated, the cleanerless process is executed. In this case, too, the brush roller 606*a* remains in contact with the photoconductor body 609*a* and operates as described above. Thereby, the post-transfer residual toner is once stirred, and occurrence of exposure memory, etc. can be prevented.

Immediately before switching the cleaner-equipped process to the cleanerless process, the bias polarity of the brush roller 606*b* may be reversed in the state in which the image formation is not performed, thereby discharging the toner retained in the brush. By this operation, the negative-polarity toner retained in the brush roller 606*b* is discharged to the photoconductor body 609*b* and recovered by the blade 604*b*. Thereafter, the bias of the brush roller 606*b* is restored to the normal polarity and the blade 604*b* is separated. Thus, when the cleanerless operation is started, there is no fear of stain of the brush from the beginning.

In short, the polarity of the brush roller 606*a*, 606*b* is reversed in order to discharge the negative-polarity toner. For example, it is possible to successively turn on/off the bias at short cycles, which is applied to the brush roller 606*a*, thereby to apply an AC, as well as to reverse the polarity. Preferably, this operation should be performed at least for a time period corresponding to one rotation of the brush of the brush roller 606*a*, 606*b*. In this case, the diameter of the brush employed is ϕ12 and the brush is rotated in the same direction as the photoconductor body with a peripheral speed ratio of 2:1. Thus, little time is consumed and the performance of the apparatus does not deteriorate.

The above-described brush may be not of a roller type, but of a stationary type. The stationary type brush is inferior to the brush roller with respect to the durability and the performance of discharging toner from the brush. It is thus better to take the following measure. That is, not only immediately before switching to the cleanerless configuration, but also at the non-image formation time during the cleanerless process, the cleaning blade is once put in contact and the operation of switching the bias to the brush, as described above, is periodically performed.

Assume the following case. The first-stage image forming section of the image forming apparatus forms a yellow image, the second-stage image forming section forms a magenta image, and the third-stage image forming section forms a cyan image. The printing ratio in yellow is excessively high, the printing ratio in cyan is low, and printing is effected based on such an image signal that yellow does not substantially overlap with magenta or cyan. In this case, even when the cleanerless process is set, it is better to automatically switch the operation of the third-stage image forming section, which forms the cyan image, to the cleaner-equipped configuration. The reason is as follows. If the printing ratio in yellow as a single color is excessively high, the amount of yellow toner that is reverse-transferred to the cyan image formatting section would excessively increase.

With the setting of the cleanerless configuration, a great amount of yellow toner mixes into the cyan developing device, and color mixing would occur.

In this case, if the image forming apparatus is set in a low-cost mode, the apparatus basically operates in the cleanerless scheme. Only when the cleanerless scheme is disadvantageous, the operation scheme is automatically switched to the cleaner-equipped scheme. If the apparatus is set in a high-image-quality mode, the apparatus basically performs image formation in the cleaner-equipped scheme.

In this way, if the cleaner is automatically on/off controlled by the image signal, it becomes possible to prevent color mixing, which is a problem of the cleanerless process. In addition, if the conditions for exposure, etc. are altered in accordance with this control, an image suited to each case can be obtained.

In the case where the image signal is only a black signal, the cleaning blades of the first- to third-stage image forming sections are separated. In the second embodiment, the image forming section for black is disposed at the final stage (fourth stage). Thus, there is no possibility of color mixing due to reverse transfer in the upstream-side image forming sections.

In many cases, when a monochromatic image is printed, the photoconductor bodies for colors are separated from the belt unit, etc., and the operation of the photoconductor bodies is stopped. Thereby, abrasion of the color photoconductor bodies is prevented.

In the second embodiment, however, the blades are separated, and even if the photoconductor bodies are rotated, the photoconductor bodies are hardly abraded. Therefore, there is no need to separate the belt or stop the photoconductor bodies, as in the above case.

According to the user's preference, as described above, it is determined whether the monochromatic (black) image forming section K36 should be set to adopt the cleanerless process or the cleaner-equipped process. The CPU 110 alters the conditions for exposure, etc. in accordance with the setting. This prevents unnecessary abrasion of the color photoconductor bodies at the time of monochromatic image printing.

The above-described switching operation may be performed depending on the kind of paper. In particular, in the direct transfer scheme, toner is directly transferred from the photoconductor body to paper. Depending on the kind of paper, it is possible that a great amount post-transfer residual toner occurs, or the amount of reverse-transfer toner increases. Thus, in a case where printing is effected on paper with a predetermined thickness or more, the CPU 110 selects the cleaner-equipped configuration setting. In a manual feed mode, the CPU 110 basically adopts the cleaner-equipped configuration setting. Normally, paper sheets with regular specifications are fed from an ordinary sheet cassette. In the case of manual feed, it is unrecognizable what kind of paper is fed. Therefore, this setting is advantageous for enhancing image quality.

The image forming apparatus may include means for detecting the kind of paper. Based on a detection signal from the detection means, the settings may be switched. For example, the means for detecting the kind of paper measures the thickness of paper using an optical sensor, or measures the resistance value by supplying an electric current to the convey roller.

Figure 16:
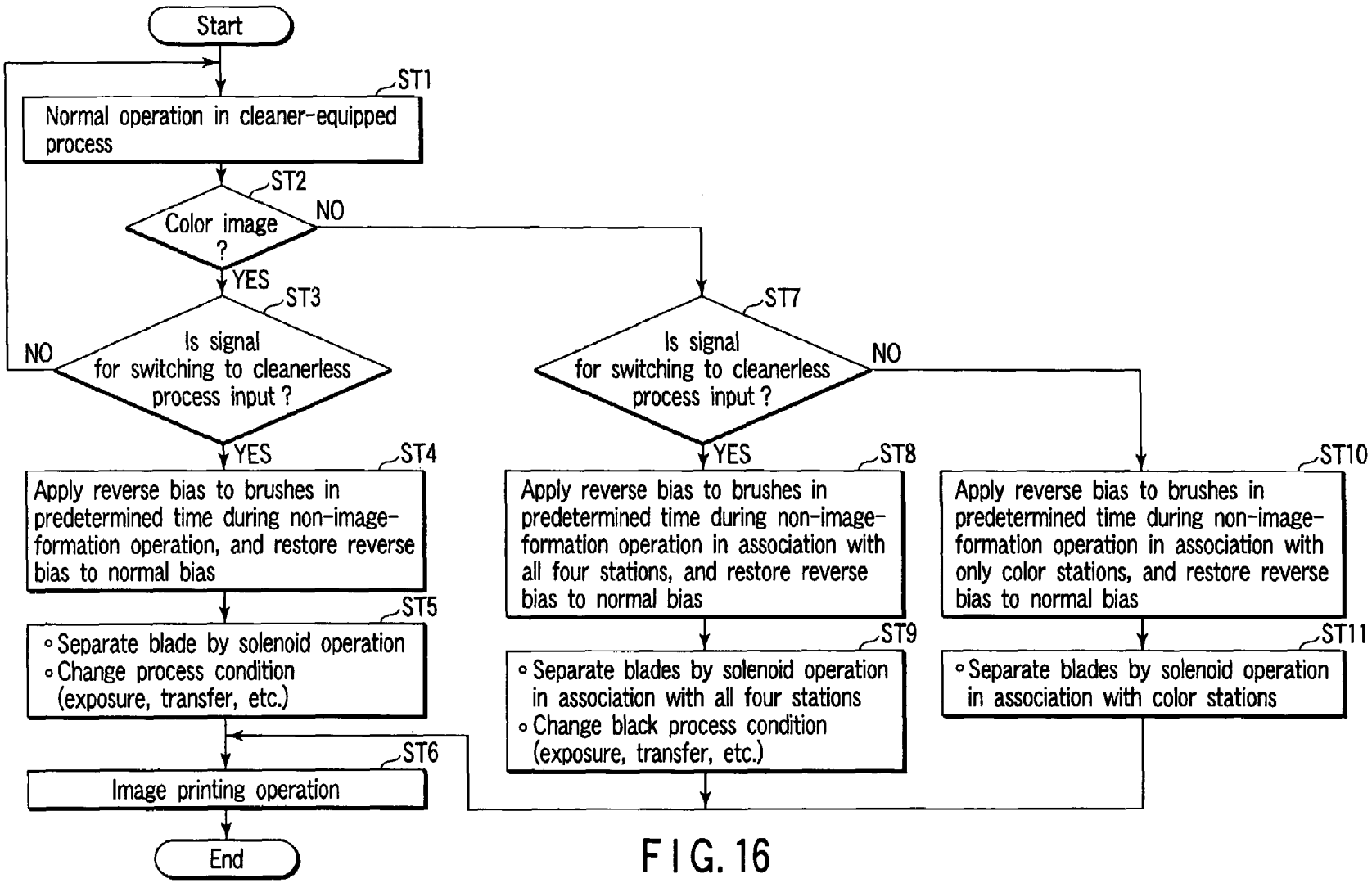
FIG. 16 is a flow chart for explaining an operation of bias reversal at a time of monochromatic printing and switching.

Next, referring to a flow chart of FIG. 16, a description is given of the above-mentioned bias reverse operation at the time of the monochromatic printing and the switching.

Normally, the CPU 110 controls a cleaner-equipped process operation (ST1).

The CPU 110 checks whether a color image is to be printed (ST2).

If the color image is to be printed in step ST2, the CPU 110 checks whether a signal for switching to the cleanerless process is received (ST3).

If the signal is not received in step ST3, the CPU 110 returns to step ST1.

If the signal is received in step ST3, the CPU 110 applies a reverse bias to the brushes Y32, M32, C32 and K32 for a predetermined time period during the non-image-formation operation, and then the CPU 110 restores to the reverse bias to the normal bias (ST4).

Subsequently, the CPU 110 activates the solenoids Y31, M31 and C31 of the image forming sections Y36, M36 and C36, thereby separating the blades Y30, M30 and C30 from the associated photoconductor bodies (ST5).

The CPU 110 controls the image printing operation (ST6).

If the monochromatic image to be printed in step ST2, the CPU 110 checks whether a signal for switching to the cleanerless process is received (ST7).

If the signal is received in step ST7, the CPU 110 applies a reverse bias to the brushes Y32, M32, C32 and K32 for a predetermined time period during the non-image-formation operation in association with the image forming sections Y36, M36, C36 and K36, and then the CPU 110 restores to the reverse bias to the normal bias (ST8).

Subsequently, the CPU 110 activates the solenoids Y31, M31, C31 and K31 of the image forming sections Y36, M36, C36 and K36, thereby separating the blades Y30, M30, C30 and K30 from the associated photoconductor bodies. Further, the CPU 110 changes the black process conditions (exposure, transfer, etc.) (ST9) and goes to step ST6.

If the signal is not received in step ST7, the CPU 110 applies a reverse bias to the brushes Y32, M32 and C32 for a predetermined time period during the non-image-formation operation in association with the image forming sections Y36, M36 and C36, and then the CPU 110 restores to the reverse bias to the normal bias (ST10).

Subsequently, the CPU 110 activates the solenoids Y31, M31 and C31 of the image forming sections Y36, M36 and C36, thereby separating the blades Y30, M30 and C30 from the associated photoconductor bodies (ST11), and the CPU 110 advances to step ST6.

Figure 17:
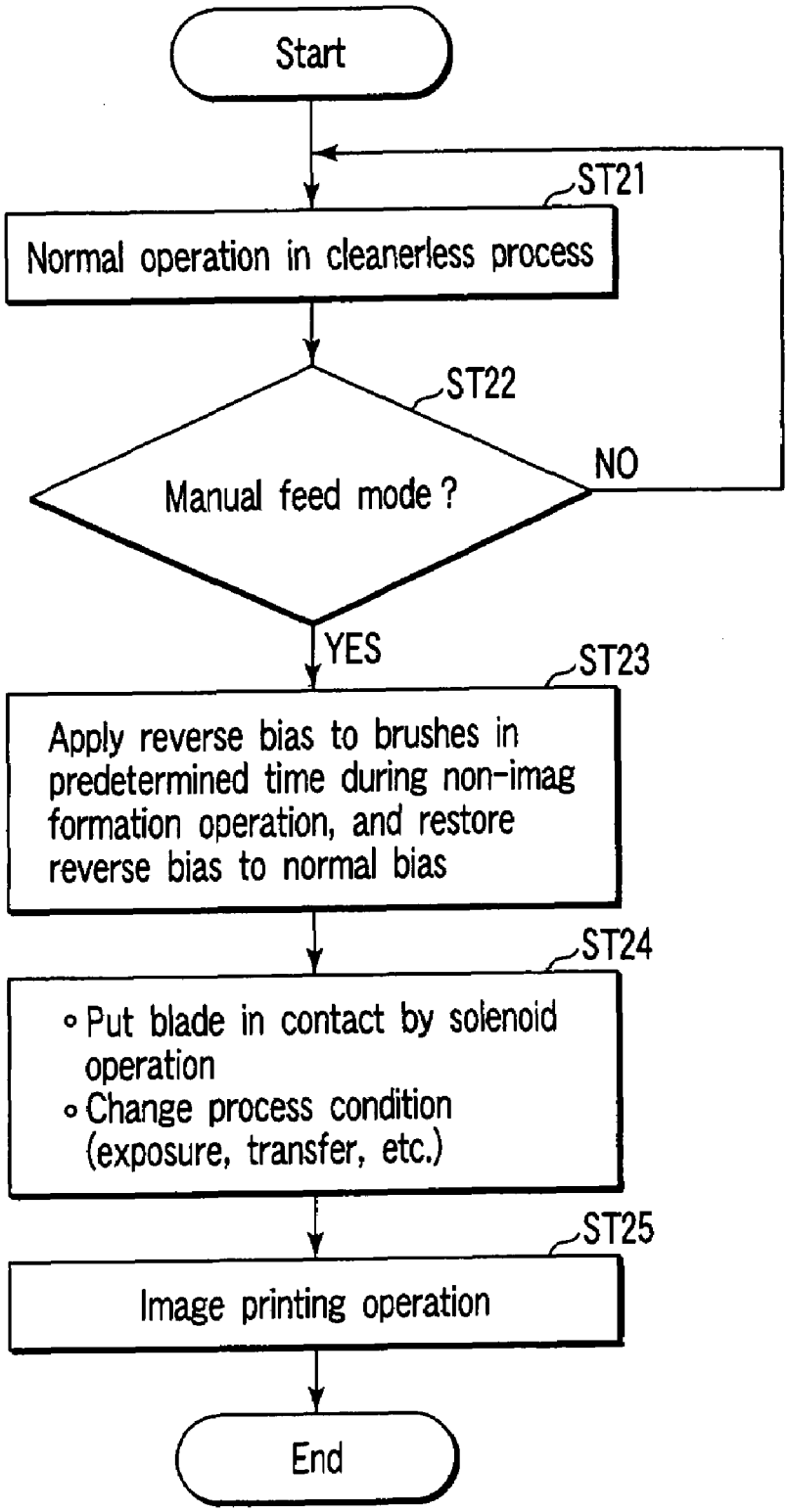
FIG. 17 is a flow chart for explaining an operation for changing a setting in a manual feed mode.

Next, the above-described operation for changing the setting in the manual feed mode is explained with reference to a flow chart of FIG. 17.

Normally, the CPU 110 controls the cleanerless process operation (ST21).

If the manual feed mode is set (ST22), the CPU 110 applies a reverse bias to the brushes Y32, M32, C32 and K32 for a predetermined time period during the non-image-formation operation, and then the CPU 110 restores to the reverse bias to the normal bias (ST23).

Subsequently, the CPU 110 activates the solenoids Y31, M31, C31 and K31 of the image forming sections Y36, M36, C36 and K36, thereby bringing the blades Y30, M30, C30 and K30 into contact with the associated photoconductor bodies. Further, the CPU 110 changes the black process conditions (exposure, transfer, etc.) (ST24).

Then, the CPU 110 controls the image printing operation (ST25).

Next, a third embodiment of the invention is described.

The above-described first and second embodiments relate to the cleanerless process of the photoconductor bodies. This cleanerless process may be combined with the cleanerless process for the transfer belt or intermediate transfer medium.

Figure 18:
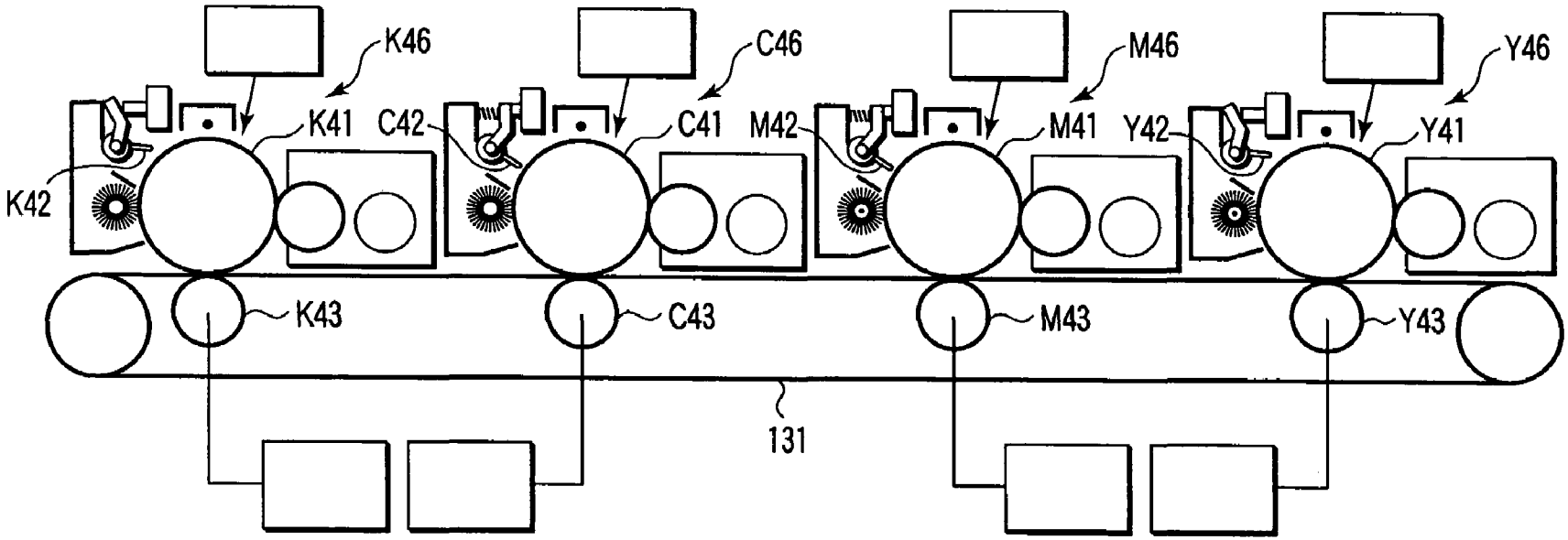
FIG. 18 shows an example of the structure of a direct-transfer-type image forming apparatus according to a third embodiment.

FIG. 18 shows an example of the structure of a direct-transfer-type image forming apparatus according to the third embodiment. In the direct-transfer-type image forming apparatus according to the third embodiment, a plurality of image forming sections (stations) Y46, M46, C46 and K46 are arranged above a transfer belt 131 that serves as paper conveying means.

The first-stage image forming section Y46 forms a yellow image, the second-stage image forming section M46 forms a magenta image, the third-stage image forming section C46 forms a cyan image, and the fourth-stage image forming section K46 forms a black image.

As is described later in greater detail, the image forming section Y46 includes a photoconductor body Y41, a blade Y42 and a transfer roller Y43. The image forming section M46 includes a photoconductor body M41, a blade M42 and a transfer roller M43. The image forming section C46 includes a photoconductor body C41, a blade C42 and a transfer roller C43. The image forming section K46 includes a photoconductor body K41, a blade K42 and a transfer roller K43.

Contact/separation of the cleaning blades Y42, M42, C42 and K42 on/from the photoconductor bodies is controlled by the CPU 110 through the cleaner control unit 118.

In the normal printing operation in the direct-transfer scheme, toner does not adhere to the belt. However, in order to execute an image quality maintaining control before starting an image printing operation or during an operation in a paper-feed interval, a patch image or the like is intentionally printed on the belt. In addition, in case of paper jam, a great amount of unnecessary toner adheres to the belt.

In an ordinary cleaner-equipped image forming apparatus, such toner is recovered by a cleaner provided at the belt.

On the other hand, the image forming apparatus according to the third embodiment shown in FIG. 18 adopts a belt cleanerless scheme wherein the belt is not provided with a cleaner. In this apparatus, a bias to the photoconductor body or the transfer roller is switched, thereby bringing back such toner onto the photoconductor body.

In the case where this belt cleanerless scheme is adopted, there is no need to provide a cleaner on the belt. Thus, it is easy to increase the life of the belt and to execute a meandering control, and a low cost can be achieved in general. When toner on the belt is to be recovered onto the photoconductor body, there arises no problem if toner of a specific color is exactly brought back onto the specified image forming section (station). However, in the case where the photoconductor body adopts the cleanerless process, toner relating to a jam image, etc., which cannot be brought back onto the specified image forming section, is restored into a black developing device in which color mixing is less visible. Although color mixing is less visible in the black developing device, if the amount of such toner increases, the hue varies and the real black could not be obtained disadvantageously.

In the third embodiment, when mixed-color toner is recovered, the cleaner, which is provided on the photoconductor body side, is put in contact with the photoconductor body, and the toner is removed by the cleaner. In the case of an image with substantially a single color without color mixing, the cleaner is separated and the toner is recovered into the developing device.

In this case, the structure of the first embodiment, wherein the cleaner-equipped configuration and the cleanerless configuration are switched by replacement of the cartridge, may be modified such that the image forming apparatus body prompts, by display, replacement of the cartridge so that the user may replace the cartridge and execute the above operation. This configuration, however, is a little time-consuming, so the automatic switching on/off of the cleaner, as in the second embodiment, is preferable.

Figure 19:
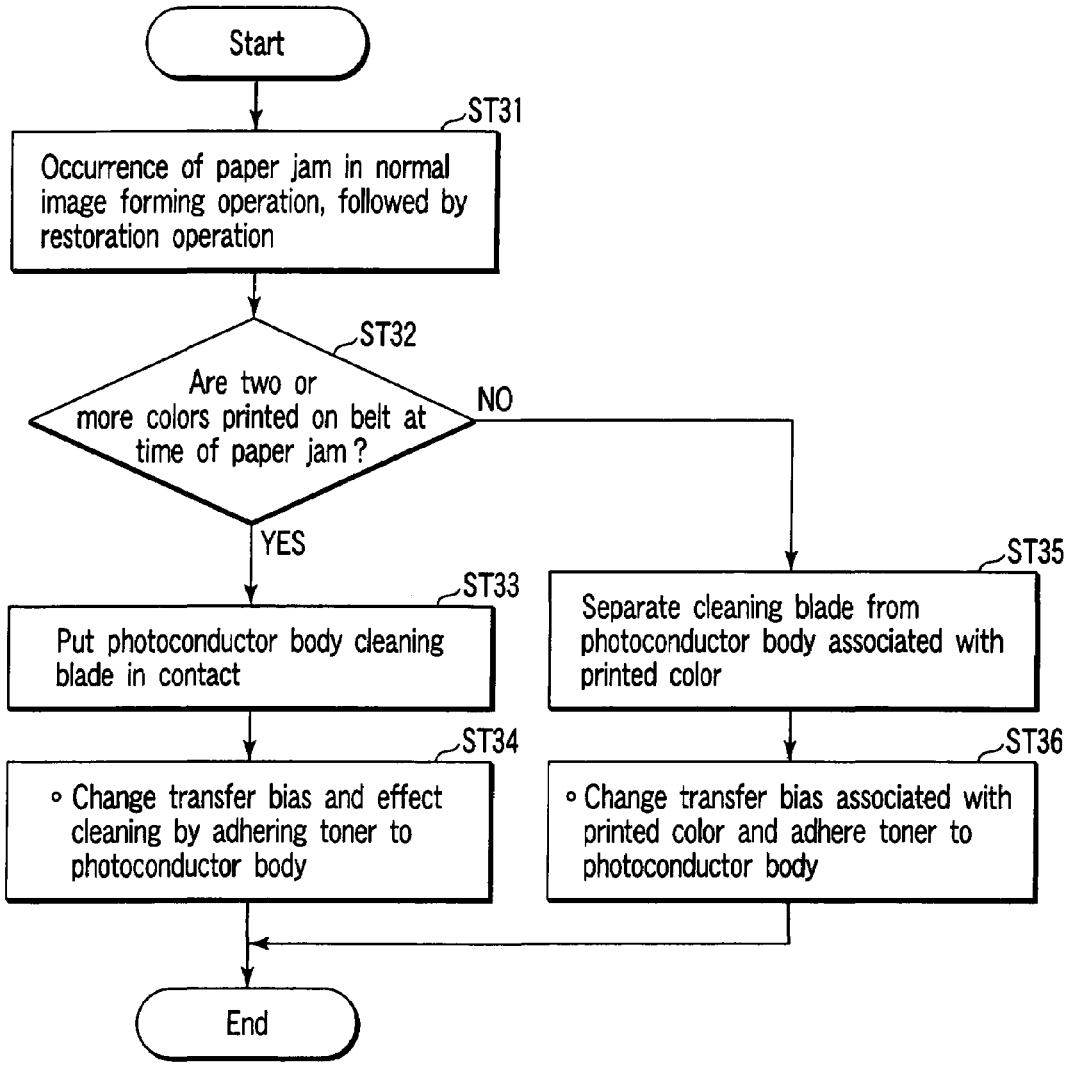
FIG. 19 is a flow chart for explaining an operation of bias reversal at a time of monochromatic printing and switching.

Next, the above-mentioned bias reverse operation at the time of the monochromatic printing and the switching is described with reference to a flow chart of FIG. 19.

A paper jam occurs in the normal image forming operation, and a subsequent restoration operation is initiated (ST31).

If two or more color toners are printed on the belt 131 at the time of the paper jam in step ST31 (ST32), the CPU 110 brings the cleaning blades Y42, M42, C42 and K42 into contact with the photoconductor bodies Y41, M41, C41 and K41 of the image forming sections Y46, M46, C46 and K46 (ST33).

The CPU 110 changes the transfer bias to the transfer rollers Y43, M43, C43 and K43 and executes cleaning by causing the toner on the belt 131 to be adhered to the photoconductor bodies Y41, M41, C41 and K41 (ST34).

If a single-color toner is printed on the belt 131 in step ST32, the CPU 110 separates the blade (Y42, M42, C42, K42) associated with the printed color (ST35).

Subsequently, the CPU 110 changes the transfer bias to the transfer roller (Y43, M43, C43, K43) associated with the printed color and executes cleaning by causing the toner on the belt 131 to be adhered to the photoconductor body (Y41, M41, C41, K41) (ST36).

As has been described above, according to the embodiments of the present invention, the cleanerless process and the ordinary cleaner-equipped process are switched in the same image forming apparatus by replacing the cartridge. Further, the process conditions are automatically changed to those suited to the cleanerless process or the cleaner-equipped process. Thereby, the high-image-quality setting or low-cost setting can be selectively used according to the user's preference. For example, even when the same image forming apparatus is used, a user who places importance on the image quality uses the cleaner-equipped cartridge, and a user who places importance on the cost uses the cleanerless cartridge.

In addition, even if the process unit is not switched, the cleaning blade in the cleaner section for the photoconductor body is configured to be separable from the photoconductor body. The cleaner is switched on/off by the user operation. In this case, the initial cost is increased by the provision of the separation mechanism. However, the user is free from the procedure for replacing the cartridge (unit), and the cleaner-equipped configuration and the cleanerless configuration can easily be switched.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An image forming apparatus that forms an image using a photoconductor body, comprising:

switching means for effecting switching between a state in which cleaning means is operated for the photoconductor body, and a state in which the cleaning means is not operated for the photoconductor body; and control means for controlling a setting change of an image formation condition between a case where the cleaning means is operated by the switching means, and a case where the cleaning means is not operated by the switching means, wherein the switching means includes detection means for detecting the kind of paper on which an image is formed, and the switching means switches on/off the cleaning means in accordance with a detection result of the detection means.

2. The image forming apparatus according to claim 1, wherein the switching means performs a contact/separation operation for contacting/separating a blade, which serves as the cleaning means, on/from the photoconductor body.

3. The image forming apparatus according to claim 1, wherein the switching means effects switching between the state in which the cleaning means is operated for the photoconductor body and the state in which the cleaning means is not operated for the photoconductor body in accordance with a high-image-quality mode or a low-cost mode.

4. The image forming apparatus according to claim 1, wherein the switching means switches on the cleaning means in a case where paper is fed from a manual feed tray.

5. The image forming apparatus according to claim 1, wherein the switching means effects switching between the state in which the cleaning means is operated for the photoconductor body and the state in which the cleaning means is not operated for the photoconductor body in accordance with an operation from an operation panel.

6. The image forming apparatus according to claim 1, wherein the image forming apparatus includes a plurality of said photoconductor bodies that form a black image and other color images, and when a monochromatic image is formed, the switching means switches off the cleaning means for the photoconductor bodies other than the photoconductor body for black.

7. The image forming apparatus according to claim 1, wherein the control means changes the setting of at least one of image formation conditions relating to an exposure light modulation scheme, an exposure light amount and a transfer bias.

8. An image forming apparatus that forms an image using a photoconductor body, comprising:

a switching unit which effects switching between a state in which a cleaner is operated for the photoconductor body, and a state in which the cleaner is not operated for the photoconductor body; and a control unit which controls a setting change of an image formation condition between a case where the cleaner is operated by the switching unit, and a case where the cleaner is not operated by the switching unit, wherein the switching unit includes a detection unit which detects the kind of paper on which an image is formed, and the switching unit switches on/off the cleaner in accordance with a detection result of the detection unit.

9. The image forming apparatus according to claim 8, wherein the switching unit which performs a contact/separation operation for contacting/separating a blade, which serves as the cleaner, on/from the photoconductor body.

10. The image forming apparatus according to claim 8, wherein the switching unit effects switching between the state in which the cleaner is operated for the photoconductor body and the state in which the cleaner is not operated for the photoconductor body in accordance with a high-image-quality mode or a low-cost mode.

11. The image forming apparatus according to claim 8, wherein the switching unit switches on the cleaner in a case where paper is fed from a manual feed tray.

12. The image forming apparatus according to claim 8, wherein the switching unit effects switching between the state in which the cleaner is operated for the photoconductor body and the state in which the cleaner is not operated for the photoconductor body in accordance with an operation from an operation panel.

13. The image forming apparatus according to claim 8, wherein the image forming apparatus includes a plurality of said photoconductor bodies that form a black image and other color images, and when a monochromatic image is formed, the switching unit which switches off the cleaner for the photoconductor bodies other than the photoconductor body for black.

14. The image forming apparatus according to claim 8, wherein the control unit which changes the setting of at least one of image formation conditions relating to an exposure light modulation scheme, an exposure light amount and a transfer bias.

* * * * *